United States Patent [19]

Sato et al.

[11] 4,173,542

[45] Nov. 6, 1979

[54] HYDRAULIC FLUID COMPRISING A BORATE ESTER AND CORROSION INHIBITING AMOUNTS OF AN OXYALKYLATED ALICYCLIC AMINE

[75] Inventors: Teruyuki Sato, Yawata; Kunio Kawakatsu, Kyoto, both of Japan

[73] Assignee: Sanyo Chemical Industries, Ltd., Kyoto, Japan

[21] Appl. No.: 907,723

[22] Filed: May 19, 1978

[30] Foreign Application Priority Data

May 31, 1977 [JP] Japan ..... 52-64420

[51] Int. Cl.[2] ..... C10M 3/26; C10M 3/48

[52] U.S. Cl. ..... 252/78.1; 252/77; 252/392

[58] Field of Search ..... 252/78.1, 77, 51.5 R, 252/49.6, 392

[56] References Cited

U.S. PATENT DOCUMENTS

| | | | |
|---|---|---|---|
| 3,711,410 | 1/1973 | Sawyer et al. | 252/78.1 |
| 3,972,822 | 8/1976 | Sato et al. | 252/78.1 |
| 4,116,846 | 9/1978 | Sato et al. | 252/78.1 |

*Primary Examiner*—Harris A. Pitlick

*Attorney, Agent, or Firm*—Oblon, Fisher, Spivak, McClelland & Maier

[57] ABSTRACT

Hydraulic fluid compositions having improved non-corrosive properties to metals are formed from (A) a hydraulic fluid containing a borate ester and (B) an oxyalkylated alicyclic amine.

18 Claims, No Drawings

HYDRAULIC FLUID COMPRISING A BORATE ESTER AND CORROSION INHIBITING AMOUNTS OF AN OXYALKYLATED ALICYCLIC AMINE

BACKGROUND OF THE INVENTION

1. Field of the Invention

This invention relates to hydraulic fluid compositions, particularly brake fluid compositions for use in hydraulic brake systems of automobiles.

2. Description of the Prior Art

Recently, automobiles have tended to become faster and larger, at the same time that greater safety is required. For this purpose, hydraulic fluids of higher performance are strongly demanded.

The first requirement for hydraulic fluids is to be free from the so called "vapor lock phenomenon". This phenomenon is caused by the vaporization of hydraulic fluids and makes brake control impossible. Consequently, brake fluids having a higher boiling point are demanded. Efforts have been made to develop hydraulic fluids having a high boiling point even in the moist state and which can maintain the higher boiling point for a long period of time. The conventional hydraulic fluids which contain a high molecular weight polyether as base polymer and a low molecular weight glycol ether as diluent, are hygroscopic and tend to suffer a severe drop in their boiling points attendant upon moisture absorption. Such hydraulic fluids are therefore unlikely to pass the standard of DOT 4 (higher than 155° C.) with respect to the wet equilibrium reflux boiling point (boiling point in a moist state), according to the hydraulic fluid specification of U.S. Department of Transportation [DOT].

Hitherto, there have been proposed several hydraulic fluids which contain borate esters of glycol ethers. Such hydraulic fluids may be adequate regarding their wet equilibrium reflux boiling points, and some of them have high enough wet equilibrium reflux boiling points to pass the standard of DOT 4. But these fluids have the drawback that they cause corrosion of metals.

It has been proposed heretofore to add to such fluids corrosion inhibitors such as alkanolamines (mono-, di- and triethanolamine and the like). By using such corrosion inhibitors prevention of corrosion for a short time may be attained; but such known corrosion inhibitors are not effective in inhibiting the metal corrosion for a long period of time. A need exists therefore, for hydraulic fluids having improved non-corrosive properties to metals for a long period of time (test such as 2000 hours at 100° C.).

SUMMARY OF THE INVENTION

Accordingly, it is one object of this invention to provide hydraulic fluid compositions which have improved non-corrosive properties to metals for a long period of time and a high boiling point.

It is another object of this invention to provide hydraulic fluid compositions which can meet the requirements for DOT 4 grade.

Briefly, these and other objects of the invention as hereinafter will become more readily apparent have been attained broadly by providing hydraulic fluid compositions comprising (A) a hydraulic fluid containing a borate ester and (B) an oxyalkylated alicyclic amine.

DETAILED DESCRIPTION OF THE PREFERRED EMBODIMENTS

The oxyalkylated alicyclic amine (B) used in this invention is a compound considered, in its molecular structure, to be an addition product of an alicyclic amine with at least one alkylene oxide. The compound may be produced by any known method; but a detailed description will be given of a method for producing the above addition product, for convenience.

Suitable amines include alicyclic monoamines such as cycloalkylamines (cyclopropylamine, cyclobutylamine, cyclopentylamine, cyclo hexylamine, menthylamine and the like), and dicycloalkylamines (dicyclohexylamine and the like); and alicyclic polyamines such as 1,4-diaminocyclohexane, diamino dicyclohexylmethane and aminoalkylcycloalkylamines (N-aminopropylcyclohexylamine, N-aminoethylcyclohexylamine and the like). Preferred are cyclohexylamine and dicyclohexylamine.

Suitable alkylene oxides include, for example, alkylene oxides having 2 to 4 carbon atoms such as ethylene oxide (EO), propylene oxide (PO), 1,2-, 2,3- or 1,3-butylene oxide (BO), tetrahydrofuran and at least two of these alkylene oxides (such as a combination of PO and EO). Preferred are EO and PO.

The amounts of the alkylene oxide to be added to the alicyclic amine are usually 1 to 10, preferably 1 to 3 moles of the alkylene oxide per mole of the amine.

Examples of the oxyalkylated alicyclic amines are oxyalkylated alicyclic monoamines such as N-(2-hydroxyethyl)cyclohexylamine, N,N-di(2-hydroxyethyl)cyclohexylamine, N,-(2-hydroxypropyl)cyclohexylamine, N,N-di(2-hydroxypropyl)cyclohexylamine, N-(2-hydroxyethyl)dicyclohexylamine, N-(2-hydroxypropyl)dicyclohexylamine and oxyalkylated alicyclic polyamines such as N,N,N'-tri(2-hydroxyethyl)-1,4-diaminocyclohexane, N,N,N'-tri(2-hydroxyethyl)-N-aminopropylcyclohexylamine, and mixtures thereof. Preferred are oxyethyl ated and oxypropylated alicyclic monoamines. More preferred are N-(2-hydroxyethyl)-cyclohexylamine and N,N-di-(2-hydroxyethyl) cyclohexylamine and N-(2-hydroxyethyl)dicyclohexylamine.

The oxyalkylated alicyclic amines may be prepared by the addition reaction of the alkylene oxide (either alone or in combination) with the alicyclic amines. At least two of these alkylene oxides may be reacted simultaneously or alternately to form mixed oxyalkylene groups, or random-or block-polyoxyalkylene group.

The hydraulic fluid containing the borate ester (A) used in the present invention is not particularly critical.

Suitable borate esters include (a) a reaction product of components (i), (ii) and/or (iii) with (iv), or mixtures thereof, wherein:

(i) is at least one polyglycol monoether of the formula (1):

$$R_1-(OA_1)_m-OH \quad (1)$$

wherein $R_1$ is $C_1$-$C_4$ alkyl, $A_1$ is $C_2$-$C_4$ alkylene and m is 2 to 8;

(ii) is at least one polyglycol of the formula (2):

$$H-(OA_2)_n-OH \quad (2)$$

wherein $A_2$ is $C_2$-$C_4$ alkylene and n is 2 to 10;

(iii) is at least one polyoxyalkylene mono- or poly-ol of the formula (3):

$$R_2[-(OA_3)_q-OH]_p \quad (3)$$

wherein $R_2$ is a residue of a $C_1$-$C_8$ mono-ol or $C_1$-$C_8$ poly-ol, $A_3$ is $C_2$-$C_4$ alkylene, p is 1 to 4 and q is a number such that the molecular weight of component (iii) is 1,000 to 5,000; and (iv) is at least one boron compound having an ability to form borate esters.

Suitable polyglycol monoethers (i) include monomethyl, monoethyl, monopropyl (n- and iso-), and monobutyl (n-, iso-, sec-, and tert-) ethers of polyalkylene glycol such as diethylene glycol, triethylene glycol, tetraethylene glycol, pentaethylene glycol, hexaethylene glycol, heptaethylene glycol, octaethylene glycol, dipropylene glycol, tripropylene glycol, tetrapropylene glycol, addition products of 1 to 5 moles of propylene oxide (PO) each with ethylene glycol, diethylene glycol, triethylene glycol and tetraethylene glycol, and mixtures thereof. Preferred are diethylene glycol monomethyl ether, triethylene glycol monomethyl ether, tetraethylene glycol monomethyl ether, pentaethylene glycol monomethyl ether, hexaethylene glycol monomethyl ether, triethylene glycol monoethyl ether, triethylene glycol monobutyl ether, tetraethylene glycol monoethyl ether, tetraethylene glycol monobutyl ether, and addition products of 1 to 3 moles of PO with diethylene glycol monomethyl ether or triethylene glycol monomethyl ether. More preferred are triethylene glycol monomethyl ether, triethylene glycol monoethyl ether, triethylene glycol monobutyl ether, tetraethylene glycol monomethyl ether, tetraethylene glycol monoethyl ether and tetraethylene glycol monobutyl ether.

Suitable polyglycols (ii) include, for example, diethylene glycol, triethylene glycol, tetraethylene glycol, polyethylene glycol (M.W. [an average molecular weight ] 200–300), tripropylene glycol, polypropylene glycol (M.W. 200–400) and random or block reaction products of EO and PO with ethylene glycol or diethylene glycol (M.W. 200–400). Preferred are diethylene glycol, triethylene glycol and polyethylene glycol (M.W. 200–300).

(In this specification all molecular weights are number-average molecular weights and are measured by hydroxyl value.)

Suitable polyoxyalkylene mono-or poly-ols (iii) include, for example, random addition products of EO and PO with mono-ols (monohydric alcohols such as methanol, ethanol, propanol and butanol): addition products of PO with poly-ols (polyhydric alcohols such as ethylene glycol, propylene glycol, glycerine, trimethylol propane and pentaerythritol); and random addition products of EO and PO with the foregoing poly-ols. Preferred are random addition products of EO and PO with butanol, addition products of PO with glycerine and random addition products of EO and PO with glycerine. Polyoxyalkylene mono-or poly-ols having a molecular weight of 1000 or more provide fluids having excellent lubricity at high temperatures. Polyoxyalkylene mono-or poly-ols having molecular weight of more than 5000 result in too great a kinematic viscosity at low temperatures (−40° C.). In formula (3), $R_2$ is a residue of a $C_1$–$C_8$ mono-or $C_1$–$C_8$ poly-ol, from which at least one hydroxyl group is eliminated.

Suitable boron compounds (iv) having an ability to form borate esters, include boric anhydride, orthoboric acid and metaboric acid. Among them, boric anhydride is preferred. The reaction products (borate esters) of components (i), (ii) and/or (iii) with component (iv) can easily be synthesized in general by heating (i), (ii) and/or (iii) with (iv) at, for example, 50° to 200° C. under reduced pressure, for example, at 100 to 1 mmHg. The reaction is preferably carried out until the boron compound is completely esterified. The foregoing borate esters include mixtures of compounds having the formula (7):

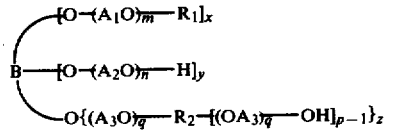

(7)

wherein x, y and z are independently zero or an integer from 1 to 3, and satisfy the equation $x+y+z=3$, and the other symbols are as defined above.

Component (A) (the hydraulic fluids containing borate ester) include those comprising the component (a) as described above, and those comprising the component (a) and at least one component selected from the group consisting of components (b), (c) and (d), wherein (b) is at least one polyglycol monoether of the formula (4):

$$R_3-(OA_4)_a-OH \quad (4)$$

wherein $R_3$ is $C_1$-$C_4$ alkyl, $A_4$ is $C_2$-$C_4$ alkylene and a is 2 to 8;

(c) is at least one polyglycol of the formula (5):

$$H-(OA_5)_b-OH \quad (5)$$

wherein $A_5$ is $C_2$–$C_4$ alkylene and b is 2 to 10; and (d) is at least one polyoxyalkylene mono- or poly-ol of the formula (6):

$$R_4[-(OA_6)_c-OH]_d \quad (6)$$

wherein $R_4$ is a residue of a $C_1$-$C_8$ mono-ol or $C_1$-$C_8$ poly-ol, $A_6$ is $C_2$-$C_4$ alkylene, d is 1 to 4 and c is a number such that the molecular weight of component (d) is 1,000 to 5,000.

Polyglycol monoethers (b) include the same ones as described for component (i). In the hydraulic fluids of this invention, components (b) and (i) can independently be selected, in other words, they may be the same or different. Polyglycols of the formula (c) also include the same ones as described for component (ii). In the hydraulic fluid of this invention, components (c) and (ii) can be independently selected. Polyoxyalkylene mono-or poly-ols of the formula (d) include the same ones as described for component (iii). In the hydraulic fluid of this invention, (d) and (iii) can be independently selected.

In the component (A) of this invention, the blending ratios of (a), (b), (c) and (d) are not especially critical, but preferably the total amount of (i) in (a) and (b) is 0 to 90% by weight (preferably 30 to 85% by weight), the total amount of (ii) in (a) and (d) is 0 to 50% by weight (preferably 5 to 45% by weight) and the total amount of (iii) in (a) and (d) is 0 to 20% by weight (preferably 1 to 15% by weight), based on the total weight of (a), (b), (c) and (d). Boron content of the component (A) is usually 0.1 to 4.6% by weight (preferably 0.2 to 1.6% by weight). When the content is less than 0.1% by weight, the wet equilibrium reflux boiling point does not pass the standard of DOT 4, while when the content exceeds 4.6% by weight, the composition becomes too viscous.

Methods for producing the component (A) of this invention are not especially critical. For example, they may be produced by mixing (i), (ii) and/or (iii) with (iv) and reacting them to obtain mixtures which contain the reaction products (a) and unreacted (excess) (i), (ii) and/or (iii) as (b), (c) and/or (d), respectively; or by mixing (i), (ii) and/or (iii) with (iv), reacting them to obtain the reaction products (a) and thereafter adding (b), (c) and/or (d).

Examples of the component (A) are those described in U.S. Pat. No. 3,711,410, U.S. Pat. No. 3,972,822 and U.S. patent application Serial No. 800,111, now U.S. Pat. No. 4,116,846.

The hydraulic fluid compositions of the present invention comprise the above-mentioned two components (A) and (B). In the hydraulic fluid compositions of this invention, the blending ratios of (A) and (B) are not especially critical, but usually the amount of (A) is 99.7 to 90% by weight (preferably 99.5 to 95% by weight), and (B) is 0.3 to 10% by weight (preferably 0.5 to 5% by weight), based on the total weight of (A) and (B). A hydraulic fluid composition with below 0.3% by weight of (B) is inadequate with respect to inhibiting metal corrosion. In contrast, a hydraulic fluid composition with larger than 10% by weight of (B) tends to be too viscous.

Methods for producing the brake fluid compositions of this invention are not especially critical. For example, they may be produced by mixing (A) and (B) or by mixing (B) with a part or one component of (A) [for example (a)] and thereafter adding the rest or the other component(s) of (A)[for example at least one of components (b), (c) and (d)].

Additional components may be incorporated into the hydraulic fluid compositions of this invention. Suitable such components include antioxidants such as phenylalphanaphthylamine, di-n-butyl amine, 2,4-dimethyl-6-tert-butyl phenol or 4,4,-butylidene bis (6-tert-butyl-m-cresol); corrosion inhibitors such as alkanolamines (including mono, di and triethanolamines), morpholine, N-(2-hydroxy ethyl) morpholine, cyclohexylamine, benzotriazole or mercaptobenzothiazole; rubber age resisters such as 2,4-dimethyl-6-tert butylphenol; pH adjusters such as mono, di and triethanolamine and the like. The total amount of these components is usually 0 to 10% (preferably 0.1 to 5%) by weight based on the total weight of the fluid composition.

The hydraulic fluid compositions of the present invention have the high non-corrosive properties to metals (such as copper, brass, aluminum, tin-plate, cast-iron and steel) for a long period of time, and rust-inhibiting properties. Such long period non-corrosive properties can be attained by using the oxyalkylated alicyclic amines according to this invention. Other inhibitors (such as other oxyalkylated amines, and alicyclic amines or other amines) without using the oxyalkylated alicyclic amines cannot provide such long period non-corrosive properties and some of them result in cloudy appearances and poor performances of blends in operation for a long time. Moreover hydraulic fluid compositions of this invention have a high boiling point and can satisfy completely the requirement for a good brake fluid in the tests of viscosity, stability at high temperature, cold temperature resistance, and resistance to rubber swelling property.

Having generally described the invention, a more complete understanding can be obtained by reference to certain specific examples, which are included for purposes of illustration only and are not intended to be limiting unless otherwise specified. In the examples, EO and PO designate ethylene oxide and propylene oxide, respectively, M.W. designates an average molecular weight and EO/PO=50/50 designates a ratio of EO to PO=50:50 by weight.

EXAMPLE 1

A hydraulic fluid composition according to the invention having the following composition (components and mixing ratios) was prepared.

| | % by weight |
|---|---|
| A hydraulic fluid containing borate esters*1 | 99.1 |
| N,N-di(2-hydroxyethyl) cyclohexylamine | 0.7 |
| benzotriazole | 0.1 |
| 4,4-butylidene bis (6-tert-butyl-m-cresol) | 0.1 |

*1 A hydraulic fluid containing borate esters obtained by reacting at 120° C. under 20 mmHg pressure a mixture having the following composition (components and mixing ratios):

| | % by weight |
|---|---|
| $B_2O_3$ | 2 |
| $C_4H_9(OCH_2CH_2)_7OH$ | 25 |
| $CH_3(OCH_2CH_2)_7OH$ | 19 |
| $CH_3(OCH_2CH_2)_8OH$ | 18 |
| $CH_3(OCH_2CH_2)_5OH$ | 10 |
| $CH_3(OCH_2CH_2)_6OH$ | 3 |
| $H(OCH_2CH_2)_8OH$ (M.W. 200) | 20 |
| A random addition product of EO and PO with glycerine (EO/PO = 50/50, M.W.2800) | 3 |

EXAMPLE 2

A hydraulic fluid composition according to the invention having the following composition (components and mixing ratios) was prepared.

| | % by weight |
|---|---|
| A hydraulic fluid containing borate esters *2 | 40 |
| $C_4H_9(OCH_2CH_2)_3OH$ | 12 |
| $CH_3(OCH_2CH_2)_3OH$ | 18 |
| $CH_3(OCH_2CH_2)_8OH$ | 10.6 |
| $CH_3(OCH_2CH_2)_5OH$ | 6 |
| $CH_3(OCH_2CH_2)_6OH$ | 2 |
| $H(OCH_2CH_2)_5OH$ | 5 |
| An addition product of PO with glycerine (M.W.3000) | 5 |
| N-(2-hydroxyethyl) dicyclohexylamine | 1.2 |
| benzotriazole | 0.1 |
| 4,4-butylidene bis(6-tert-butyl-m-cresol) | 0.1 |

*2 A hydraulic fluid containing a borate ester obtained by reacting at 100° C. under 5 mmHg pressure a mixture having the following composition (components and mixing ratios):

| | % by weight |
|---|---|
| $B_2O_3$ | 4.5 |
| $CH_3(OCH_2CH_2)_3OH$ | 95.5 |

EXAMPLE 3

Test of corrosive properties to metals was conducted with each of the hydraulic fluid compositions of this invention (compositions of Example 1 and 2) in comparision with the conventional fluids (fluids A~D)*3 Corrosive properties to metals were tested according to DOT 3 and 4, or JIS(JISK2233) Specification (100° C., 120 hours), and a modification thereof under more severe conditions (100° C., 1000 hours).

*3 Conventional fluids of A, B and C are the fluids of glycol ether type, and conventional fluid D is the same fluid composition as in Example 2, except that triethanolamine was used instead of N-(2-hydroxyethyl) dicyclo hexyl amine.

The results are given in Tables 1 and 2. They show that the compositions of this invention are superior to the conventional fluids in non-corrosive properties to metals for a long period of time.

Some of the physical properties were determined by the following procedures:

(1) Reflux boiling point (wet)

The (equilibrium) reflux boiling point was measured after 100 ml. of a sample (brake fluid) was maintained in an atmosphere of 80% relative humidity for such time that 100 ml. of standard fluid (RM-1) specified by SAE (the Society of Automotive Engineers) absorbed 3% by weight of water under the same conditions.

TABLE 1-Corrosion test 100° C., 120 hours:

| | | DOT or JIS Specification | Example 1 | Example 2 | Fluid A | Fluid B | Fluid C | Fluid D |
|---|---|---|---|---|---|---|---|---|
| Copper | Appearance (1) | | B | B | B | B | B | B |
| | Wt.change(mg/cm) | 0.4> | 0.00 | 0.014 | −0.055 | 0.00 | −0.035 | −0.020 |
| Brass | Appearance (1) | | B | B | B | B | B | B |
| | Wt.change(mg/cm) | 0.4> | −0.015 | −0.021 | −0.082 | −0.035 | −0.055 | −0.032 |
| Cast iron | Appearance (1) | | B | B | B | B | B | B |
| | Wt.change(mg/cm) | 0.4> | 0.032 | 0.028 | −0.019 | 0.082 | 0.009 | 0.025 |
| Aluminum | Appearance (1) | | A | A | A | B | A | A |
| | Wt.change(mg/cm) | 0.1> | 0.00 | 0.015 | 0.00 | −0.004 | 0.035 | 0.022 |
| Steel | Appearance (1) | | B | B | B | A | A | B |
| | Wt.change(mg/cm) | 0.2> | 0.00 | 0.017 | −0.039 | −0.055 | 0.047 | 0.030 |
| Tin plate | Appearance (1) | | A | A | A | A | B | A |
| | Wt.change(mg/cm) | 0.2> | −0.02 | 0.018 | −0.016 | −0.012 | 0.027 | 0.031 |

TABLE 2-Corrosion test 100° C., 1000 hours:

| | | Example 1 | Example 2 | Fluid A | Fluid B | Fluid C | Fluid D |
|---|---|---|---|---|---|---|---|
| Copper | Appearance (2) | a | a | a | c | c | a |
| | Appearance (1) | C | C | C | C | C | C |
| | Wt.change(mg/cm) | −0.14 | −0.13 | −0.08 | −0.83 | −1.03 | −0.35 |
| Brass | Appearance (2) | a | a | b | a | d | b |
| | Appearance (1) | B | C | C | C | C | C |
| | Wt.change(mg/cm) | −0.29 | −0.31 | −0.94 | −1.55 | −0.42 | −0.64 |
| Cast iron | Appearance (2) | a | a | a | c | b | a |
| | Appearance (1) | B | B | B | B | C | B |
| | Wt.change(mg/cm) | −0.01 | −0.03 | 0.10 | 0.16 | 0.15 | −0.09 |
| Aluminum | Appearance (2) | a | a | b | b | a | a |
| | Appearance (1) | B | B | B | B | B | B |
| | Wt.change(mg/cm) | −0.01 | −0.02 | 0.03 | 0.08 | 0.12 | −0.10 |
| Steel | Appearance (2) | a | a | b | a | a | a |
| | Appearance (1) | B | B | B | C | B | B |
| | Wt.change(mg/cm) | −0.01 | 0.03 | −0.03 | −0.79 | 0.67 | −0.08 |
| Tin plate | Appearance (2) | a | a | a | c | a | a |
| | Appearance (1) | B | B | B | B | B | B |
| | Wt.change(mg/cm) | −0.01 | 0.02 | 0.02 | 0.03 | 0.05 | −0.02 |

Note:
1. Appearance (1): Appearance (1) means appearance of a metal strip after corrosion test and after washing in water.
A No change
B A slight discoloration
C Much discoloration but no pitting or etching
D Discernible pitting or etching
2. Appearance (2): Appearance (2) means appearance of the metal strip after corrosion test and before washing in water.
a No deposit
b A little deposits
c Much deposits

EXAMPLE 4

The hydraulic fluid compositions of Examples 1 and 2 and conventional hydraulic fluids of A, B, C and D in Example 3 were tested according to the procedure of DOT 4 Specification. Pertinent data relating to these tests are shown in Table 3.

(2) Rubber swelling property

An SBR cup (base diameter 9/8 inch) for a brake cylinder was dipped in the brake fluid at 120° C. for 70 hours and then measured for increase in base diameter.

TABLE 3

| Test | DOT 4 Specification | Example 1 | Example 2 | Fluid A | Fluid B | Fluid C | Fluid D |
|---|---|---|---|---|---|---|---|
| Reflux boiling point (dry)° C. | >230 | 271 | 263 | 243 | 231 | 238 | 263 |
| Reflux boiling point (wet)° C. | >155 | 163 | 161 | 148 | 143 | 141 | 160 |
| Viscosity | | | | | | | |
| 100° C., CS | >1.5 | 2.51 | 2.43 | 2.35 | 3.36 | 2.31 | 2.45 |
| −40° C., CS | <1800 | 1637 | 1425 | 1268 | 1309 | 1032 | 1440 |
| Rubber swelling property (mm) | 0.15–1.4 | 0.42 | 0.51 | 0.47 | 0.78 | 0.87 | 0.52 |

Having now fully described the invention, it will be apparent to one of ordinary skill in the art that many changes and modifications can be made thereto without departing from the spirit or scope of the invention as set forth herein.

What is claimed as new and intended to be covered by letters patent is

1. A hydraulic fluid composition comprising (A) a hydraulic fluid containing a borate ester and (B) a corrosion inhibiting amount of an oxyalkylated alicyclic amine.

2. The hydraulic fluid composition of claim 1, wherein said oxyalkylated alicyclic amine is an addition product of an alicyclic amine with at least one alkylene oxide.

3. The hydraulic fluid composition of claim 2, wherein said alicyclic amine is an alicyclic monoamine.

4. The hydraulic fluid composition of claim 3, wherein said alicyclic monoamine is a cycloalkylamine or a dicycloalkylamine.

5. The hydraulic fluid composition of claim 3, wherein said alicyclic monoamine is cyclohexylamine or dicyclohexylamine.

6. The hydraulic fluid composition of claim 1, wherein the amount of component (A) is 99.7 to 90% by weight, and the amount of component (B) is 0.3 to 10% by weight, based on the total weight of (A) and (B).

7. The hydraulic fluid composition of claim 1, wherein said component (A) has a boron content of 0.1 to 4.6% by weight.

8. The hydraulic fluid composition of claim 1, wherein said borate ester is a reaction product of components (i), (ii) and/or (iii) with (iv), or mixtures thereof, wherein:

(i) is at least one polyglycol monoether of the formula:

$$R_1\text{-}(OA_1)_m\text{-}OH$$

wherein $R_1$ is $C_1$–$C_4$ alkyl, $A_1$ is $C_2$–$C_4$ alkylene and m is 2 to 8;

(ii) is at least one polyglycol of the formula:

$$H\text{-}(OA_2)_n\text{-}OH$$

wherein $A_2$ is $C_2$–$C_4$ alkylene and n is 2 to 10;

(iii) is at least one polyoxyalkylene mono- or poly-ol of the formula:

$$R_2[\text{-}(OA_3)_q\text{-}OH]_p$$

wherein $R_2$ is a residue of a $C_1$–$C_8$ mono-ol or $C_1$–$C_8$ poly-ol, $A_3$ is $C_2$–$C_4$ alkylene, p is 1 to 4 and q is a number such that the molecular weight of component (iii) is 1,000 to 5,000; and (iv) is at least one boron compound having an ability to form borate esters;

9. The hydraulic fluid composition of claim 8, wherein the fluid (A) comprises the reaction product (a) or mixtures thereof with at least one component selected from the group consisting of components (b), (c) and (d), wherein:

(a) is a reaction product of components (i), (ii) and/or (iii) with (iv), or mixtures thereof, wherein:

(i) is at least one polyglycol monoether of the formula:

$$R_1\text{-}(OA_1)_m\text{-}OH$$

wherein $R_1$ is $C_1$–$C_4$ alkyl, $A_1$ is $C_2$–$C_4$ alkylene and m is 2 to 8;

(ii) is at least one polyglycol of the formula:

$$H\text{-}(OA_2)_n\text{-}OH$$

wherein $A_2$ is $C_2$–$C_4$ alkylene and n is 2 to 10;

(iii) is at least one polyoxyalkylene mono-or poly-ol of the formula:

$$R_2[\text{-}(OA_3)_q\text{-}OH]_p$$

wherein $R_2$ is a residue of a $C_1$–$C_8$ mono-ol or $C_1$–$C_8$ poly-ol, $A_3$ is $C_2$–$C_4$ alkylene, p is 1 to 4 and q is a number such that the molecular weight of component (iii) is 1,000 to 5,000; and (iv) is at least one boron compound having an ability to form borate esters;

(b) is at least one polyglycol monoether of the formula:

$$R_3\text{-}(OA_4)_a\text{-}OH$$

wherein $R_3$ is $C_1$–$C_4$ alkyl, $A_4$ is $C_2$–$C_4$ alkylene and a is 2 to 8;

(c) is at least one polyglycol of the formula:

$$H\text{-}(OA_5)_b\text{-}OH$$

wherein $A_5$ is $C_2$–$C_4$ alkylene and b is 2 to 10; and (d) is at least one polyoxyalkylene mono- or poly-ol of the formula:

$$R_4[\text{-}(OA_6)_c\text{-}OH]_d$$

wherein $R_4$ is a residue of a $C_1$–$C_8$ mono-ol or $C_1$–$C_8$ poly-ol, $A_6$ is $C_2$–$C_4$ alkylene, d is 1 to 4 and c is a number such that the molecular weight of component (d) is 1,000 to 5,000.

10. The hydraulic fluid composition of claim 9, wherein the total amount of (i) in (a) and (b) is 0 to 90% by weight, the total amount of (ii) in (a) and (c) is 0 to 50% by weight and the total amount of (iii) in (a) and (d) is 0 to 20% by weight, based on the total weight of (a), (b), (c) and (d).

11. The hydraulic fluid composition of claim 10, wherein the total amount of (i) in (a) and (b) is 30 to 90% by weight.

12. The hydraulic fluid composition of claim 11, wherein the total amount of (ii) in (a) and (b) is 5 to 50% by weight.

13. The hydraulic fluid composition of claim 12, wherein the total amount of (iii) in (a) and (d) is 1 to 20% by weight.

14. The hydraulic fluid composition of claim 1, wherein 0–10% by weight, based on the total weight of the fluid composition, of at least one additional component is incorporated, being selected from the group consisting of antioxidants, other corrosion inhibitors, rubber age resisters, and pH adjusters.

15. The hydraulic fluid composition of claim 14, wherein the additional component is antioxidants.

16. The hydraulic fluid composition of claim 14, wherein the additional component is present in an amount of 0.1–5% by weight.

17. The composition of claim 8, wherein said boron compound is selected from the group consisting of boric anhydride, orthoboric acid and metaboric acid.

18. The composition of claim 17, wherein said boron compound is boric anhydride.

* * * * *